US005586674A

United States Patent [19]

Nachbauer

[11] Patent Number: 5,586,674

[45] Date of Patent: Dec. 24, 1996

[54] GOLF CLUB COVER HOLDING DEVICE FOR ATTACHMENT TO A GOLF BAG

[76] Inventor: Armand E. Nachbauer, 811 Bolivar St., Lady Lake, Fla. 32159

[21] Appl. No.: 571,473

[22] Filed: Dec. 13, 1995

[51] Int. Cl.[6] ..... A63B 55/00

[52] U.S. Cl. ..... 206/315.4; 206/315.3; 224/269; 224/918; 248/308

[58] Field of Search ..... 206/315.2, 315.3, 206/315.5, 315.4; 224/268, 269, 918; 248/304, 306, 308; 150/160

[56] References Cited

U.S. PATENT DOCUMENTS

| | | | |
|---|---|---|---|
| 2,295,370 | 9/1942 | Tritt | 248/308 |
| 3,020,013 | 2/1962 | Ochin et al. | 248/306 X |
| 3,638,284 | 2/1972 | Baker . | |
| 4,106,678 | 8/1978 | Thomas | 224/269 |
| 4,830,248 | 5/1989 | Pommenville | 224/269 |
| 5,000,238 | 3/1991 | Zeller . | |
| 5,230,507 | 7/1993 | White et al. | 224/268 X |
| 5,246,108 | 9/1993 | Nusbaum | 206/315.4 |
| 5,332,090 | 7/1994 | Tucker | 206/315.3 |
| 5,345,987 | 9/1994 | Hagar | 206/315.4 |
| 5,361,958 | 11/1994 | Fieget et al. | 224/918 X |

*Primary Examiner*—Allan N. Shoap
*Assistant Examiner*—Christopher J. McDonald
*Attorney, Agent, or Firm*—Charles R. Wilson

[57] ABSTRACT

A golf club cover device for semi-permanent attachment to a golf bag serves the purpose of promptly alerting a golfer to a missing golf club, particularly an iron. The device comprises a receiving member and an L-shaped meshing member. The receiving member has a main body with a passageway extending through it and a vertical hooking leg extending along one side. In use, the vertical hooking leg extends over an open-top edge of the golf bag and helps to hold the receiving member in place. A substantially horizontal leg of the L-shaped meshing member is configured to fit in the passageway of the receiving member for limited rotational movement. A protuberance on an enlarged terminus of the horizontal leg of the L-shaped member is used to engage a sidewall of the golf bag. A substantially vertical leg on the meshing member is used to hold the club cover. In use, the L-shaped meshing member rocks from a non-locking position to a locking position whereby the protuberance is forced into contact with the golf bag. Any club cover placed on the vertical leg of the L-shaped meshing member is prominent. The golfer has to merely glance at his golf bag and, if the club cover is still in place, realize that his golf club needs to be retrieved.

14 Claims, 2 Drawing Sheets

GOLF CLUB COVER HOLDING DEVICE FOR ATTACHMENT TO A GOLF BAG

This invention relates to a golf club cover device for attachment to a golf bag. More particularly, the invention relates to a golf club cover device which semi-permanently attaches to a golf bag and which is used to hold the club cover in a prominent manner.

BACKGROUND OF INVENTION

The game of golf is a very popular recreational sport enjoyed by a broad segment of the public. A set of golf clubs are universally carried in a cylindrical-shaped bag such that their club heads extend above an open-top edge. Many golfers protect their clubs during non-use by providing a club head cover for at least each of the woods. To a lesser extent, club head covers are also used for the irons. The conventional golf bag has worked quite well for many years in containing the golf club set in a manner whereby a particular club can be selected, used and replaced. The covers in various forms also are very prevalent and serve to protect the club heads in an easy to use fashion at minimal cost.

A problem experienced by many amateur golfers is the occasional loss at least temporarily of a golf club at the golf course. The problem is prevalent regardless of whether the golf bag with its clubs are being carried over the shoulder, in a pull cart or in a riding cart. As the golfer approaches the green, the golfer will often lay the golf bag or park the cart off the green, usually in the general vicinity of the next tee. The golfer may carry a chipping or pitching wedge and a putter with him to where the golf ball is lying. Once the ball is on the green, the wedge is laid at or near an edge of the green and the golfer putts out the hole. For whatever the reason, it has proved easy to occasionally forget the club which was temporarily laid aside and go on to the next tee. The golfer may timely remember the forgotten club and be close enough to retrieve it. Unfortunately, it may be several holes later or even days later when the club is remembered. If the golfer is fortunate, the club may be where it was originally left or returned by another golfer to the club house for eventual claiming by its owner. Other times, the club has simply disappeared and must be replaced with a new club. This, of course, is costly and very annoying.

While less troublesome, losing a club head cover is also a fairly common occurrence. To alleviate this problem, there have been developed various devices which attach to the golf bag and, when used properly, greatly lessened the chances for a club cover to be carelessly left on the ground. For example, U.S. Pat. No. 5,246,108 discloses a support for attachment to a golf bag. The support extends upwardly from the bag and is shaped to receive and hold a club cover for one of the woods. This provides a convenient place for the golfer to place a club cover when it is removed from the wood.

U.S. Pat. No. 5,345,987 also discloses an apparatus for attachment to a golf bag. It too is to hold club head covers for the woods. The apparatus serves to protect the clubs and minimizes loss or damage to the club head covers.

While the structures of the aforediscussed U.S. Pat. Nos. 5,246,108 and 5,345,987 serve a limited function of lessening the chances for loss of club covers, they do no more. It is still very possible for the golfer to leave a golf club behind, especially one of the irons. The known golf bag structures for holding club covers do not secondarily alert a golfer to a missing club. Additionally, the structures appear flimsy and not likely to last for long.

In accord with this invention, there has been developed a golf club cover device for semi-permanent attachment to a golf bag which serves to alert the golfer to a forgotten golf club. The golf club cover device serves a long felt need. It is economical to produce, easy to use, durable and effective for its intended function.

SUMMARY OF INVENTION

A golf club cover device for attachment to a golf bag serves to hold a club cover in a prominent manner whereby the golfer is immediately alerted to a missing club by simply glancing at the golf bag. The golf club cover device comprises a receiving member which is hooked to the golf bag and an L-shaped meshing member which is positioned in the receiving member and manipulated to cause the golf club cover device to be semi-permanently attached to the golf bag. The receiving member has a main body with a front wall, back wall, substantially vertical first sidewall and a generally vertical second sidewall. A hooking leg extends from the main body and substantially parallels the first sidewall to create an open channel sufficiently wide to allow the receiving member to fit onto an open-top edge of the golf bag. A passageway extends through the main body with an entry opening in the substantially vertical first sidewall. The L-shaped meshing member has a vertical leg sufficiently long that it extends above the open-top edge of the golf bag in use. A knob at the vertical leg's terminus holds the club cover. A substantially horizontal leg of the L-shaped meshing member has an enlarged terminus which is dimensioned to be received in the passageway of the receiving member. A protuberance on the enlarged terminus extends out of the entry opening of the passageway. The enlarged terminus is seated in the passageway such that in use it can be rocked from a non-locking position to a locking position whereby the protuberance on the L-shaped meshing member engages the golf bag and remains in place. Any club cover placed on the generally rounded knob of the L-shaped meshing member is conspicuous. A golfer by merely glancing at the golf bag will note the cover and immediately realize a club that belongs to the cover has been forgotten.

DETAILED DESCRIPTION OF INVENTION

The golf club cover device of the invention for use on a golf bag is described with particular reference to the drawings. Its individual components and manner of use are described in the following paragraphs.

Figure 1:
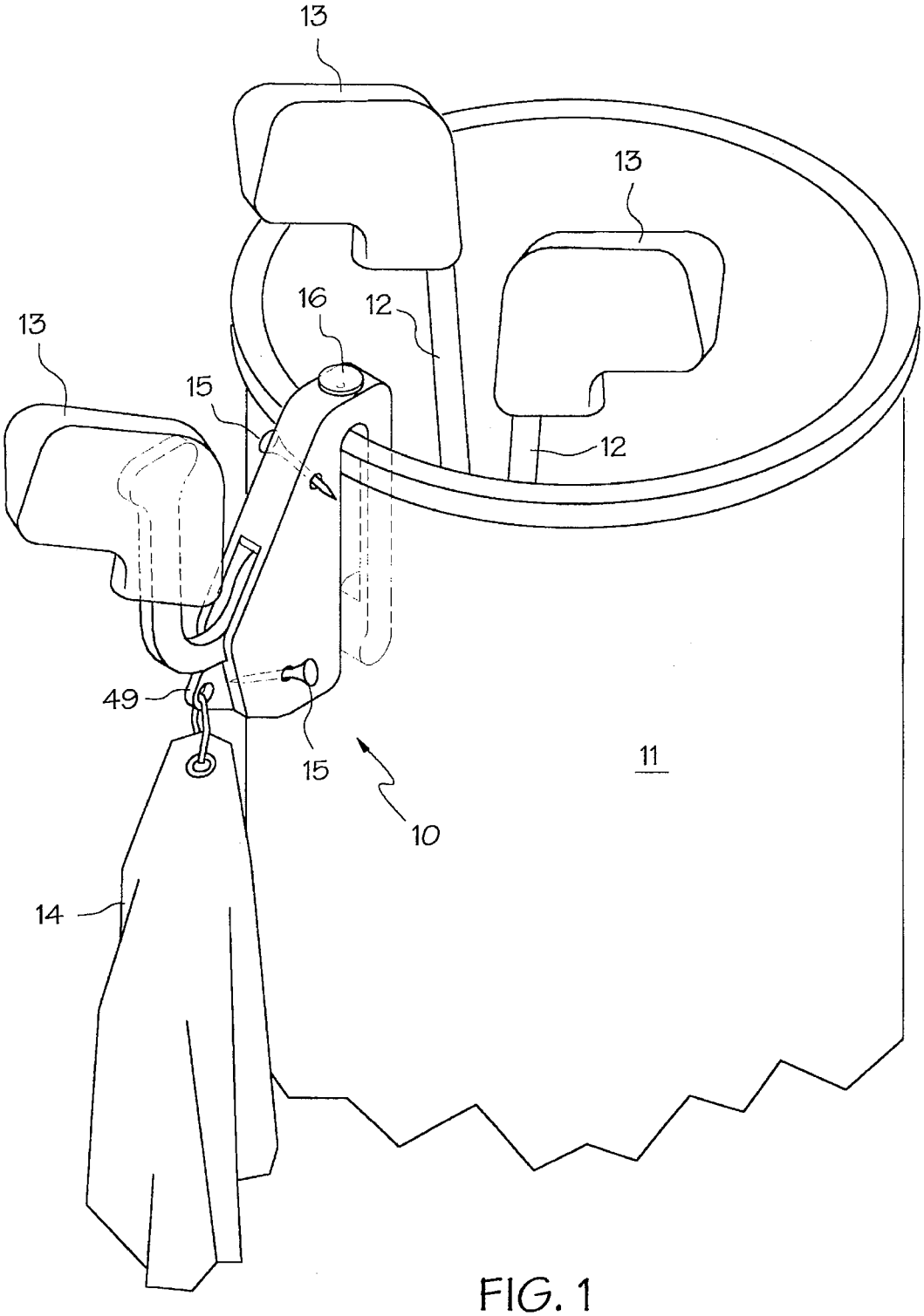
FIG. 1 is an environmental view of a golf bag with the golf club cover device of the invention semi-permanently attached thereto.

With reference to FIG. 1, there is shown the golf club cover device 10 of the invention semi-permanently attached to a golf club bag 11. For illustration purposes only, two irons 12 are depicted. A club cover 13 for an iron is positioned on the golf club cover device 10. Irons are most likely to be inadvertently misplaced on a golf course. Accordingly, the golf club cover device 10 is most useful when used to hold an iron cover and this particular use is illustrated and described in detail. Optional features on the golf club cover device 10 and further described below in detail are used to hold a hand towel 14, golf tees 15 and a ball marker 16.

Figure 2:
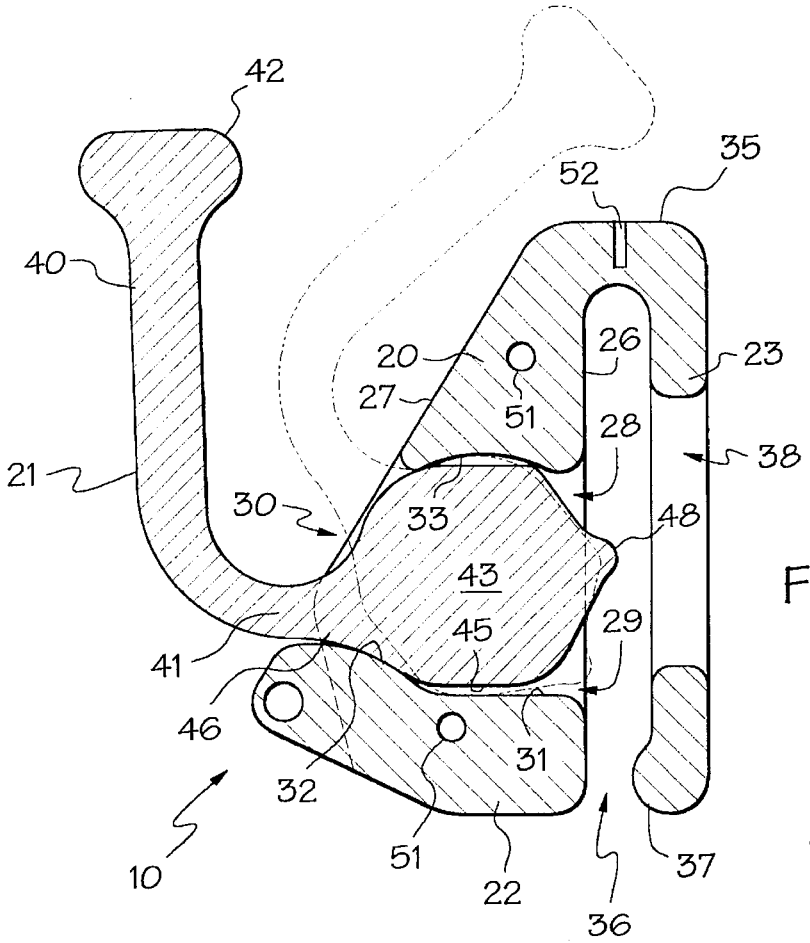
FIG. 2 is a side view in section of the golf club cover device of FIG. 1 showing an L-shaped meshing member in a locked position and, with the aid of phantom lines, in an unlocked positioned.
Figure 3:
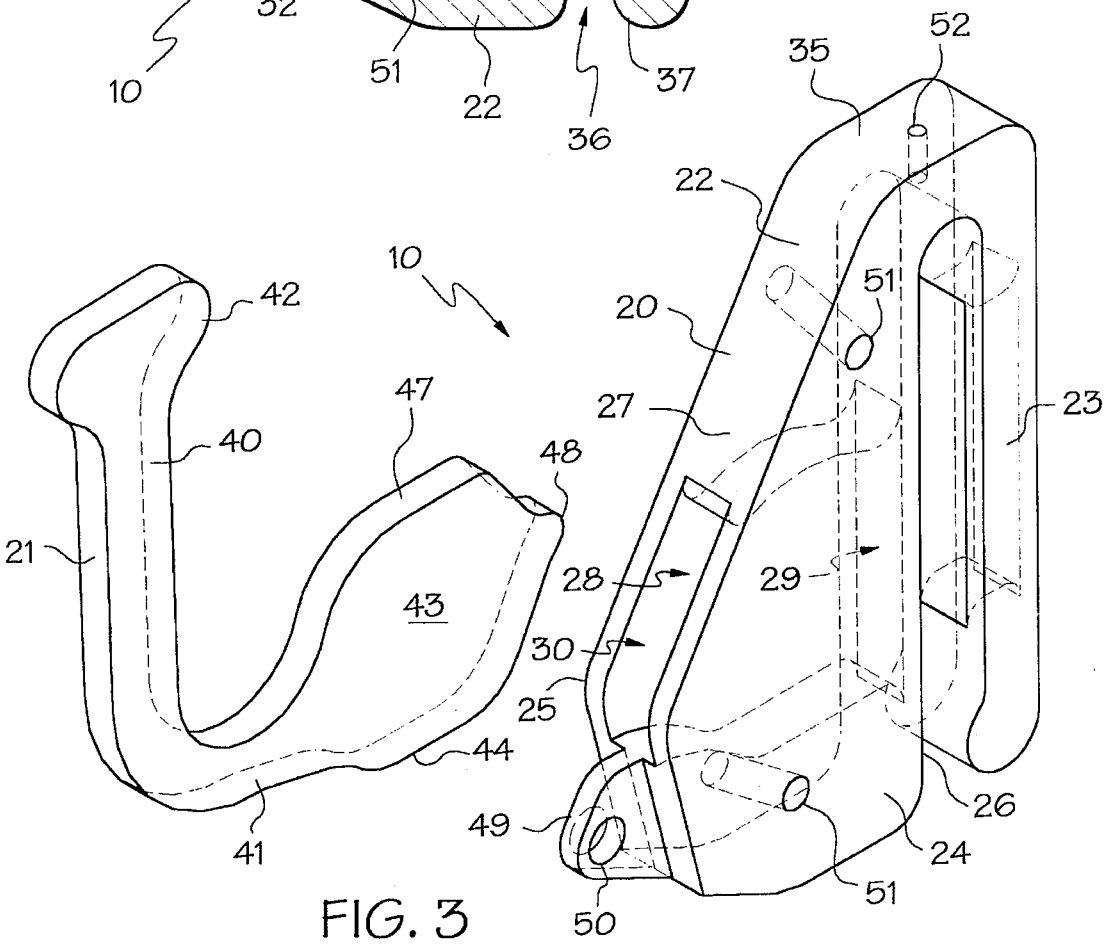
FIG. 3 is an exploded view of the golf club cover device of FIG. 1 showing two components of the golf club cover device in perspective.

As best seen in FIGS. 2 and 3, the golf club cover device 10 comprises a receiving member 20 and an L-shaped meshing member 21. Each member is made of a rigid plastic, though other materials such as a hard rubber can also be used. The two members are dimensioned to cooperatively work together to semi-permanently attach to the golf bag and to hold the club cover in a prominent manner.

The receiving member 20 of the golf club cover device 10 is configured for hooking engagement with the golf bag 11 and to receive the L-shaped meshing member 21 for limited rotational movement. The receiving member 20 has a main body 22 and a hooking leg 23. The main body 22 has a front wall 24, a back wall 25, a substantially vertical first sidewall 26 and a generally vertical second sidewall 27. Preferred and as shown, the front and back walls are substantially flat. The receiving member preferably also has a relatively narrow and substantially uniform depth, e.g. about one-half inch to about one and one-half inches.

A passageway 28 extends through the main body 22 of the receiving member 20. An entry opening 29 is in the first sidewall 26 and an exit opening 30 is in the second sidewall 27. The passageway creates a cavity within the main body 22 of the receiving member which is configured to hold the L-shaped meshing member 21 in a limited rotational manner. A lower wall of the passageway 28 has a substantially flat horizontal surface 31 extending from the entry opening 29 to an approximate mid-point and then an inclined shoulder 32 which extends to the exit opening 30. An upper wall 33 of the passageway 28 is generally arch-shaped. Width of the passageway 28 is dependent on the width of the L-shaped meshing member 21. As will become evident, it is slightly larger to freely receive the enlarged terminus of the meshing member.

The hooking leg 23 extends downwardly from the main body 22 of the receiving member 20 so as to be substantially parallel with the substantially vertical first sidewall 26. A connecting leg 35 extends from a top area of the main body 22 to the hooking leg 23 a sufficient distance such that an open channel 36 is created by the hooking leg 23 and vertical first sidewall 26. The channel 36 is wide enough to allow the receiving member 20 to fit onto an open-top edge of the golf bag and be slid down a side of the golf bag until an underside of the connecting leg 35 contacts the open-top edge. The hooking leg 23 has sufficient flexibility to hold the receiving member snugly to the golf bag. An inwardly projecting bump 37 at a terminus of the hooking leg 23 aids in holding the receiving member 20 in place.

As most evident in FIG. 2, a passageway 38 extends through the hooking leg 23. The passageway 38 is in alignment with the passageway 28 of the main body 22 for reasons which follow.

The L-shaped meshing member 21 is operatively associated with the receiving member 20 during use of the golf club cover device 10. The meshing member 21 has a substantially vertical leg 40 and a substantially horizontal leg 41. The vertical leg 40 has a sufficient length that a generally rounded knob 42 at its terminus preferably during use extends above the open-top edge of the golf bag 11. The knob 42 is rounded to best hold the club cover in a non-damaging manner. As aforementioned, the device of the invention is primarily intended to hold an irons club cover. The vertical leg and rounded knob of the meshing member is thus configured to best hold a cover for one of the irons.

The generally horizontal leg 41 of the L-shaped meshing member 21 has an enlarged terminus 43 which has a generally round shaped profile so as to engage the cavity walls of the passageway 28 of the main body of the receiving member 20. The enlarged terminus 43 is configured to fit in the passageway 28 and to rotate from about 30 degrees to about 60 degrees therein as further described below with respect to operating the golf club cover device 10. As readily apparent in FIG. 2, the enlarged terminus 28 is larger than the exit opening 30 of the passageway 28. Thus, the enlarged terminus 43 has a lower surface 44 which has a substantially flat portion 45 to mate with the substantially flat horizontal surface 31 of the passageway 28 and a curved shoulder 46 to mate with the inclined shoulder 32 of the passageway 28. Its top surface 47 is curved to mate with the arch-shape upper wall 33 of the passageway 28.

A protuberance 48 is positioned on the end of the enlarged terminus 43 of the L-shaped meshing member 21. In use, the protuberance is forced to engage a sidewall of the golf bag. It is positioned past center to properly lock onto the sidewall.

It should be evident from FIG. 2 that the L-shaped meshing member 21 is capable of limited rotational movement within the receiving member 20. In a non-locking position (shown in phantom), the vertical leg of the L-shaped meshing member is forced towards the main body 22 of the receiving member and the protuberance 48 is forced downwardly and inwardly into the passageway 28. In this position, the golf club cover device is readily slipped onto or off of the golf bag. When the vertical leg is moved to a more vertical position with respect to the main body 22 of the receiving member 20 and the golf bag 11, the protuberance 48 moves upwardly and out of the passageway 28 and into engagement with the golf bag 11. Only limited movement of the L-shaped meshing member is possible because of the confining walls of the passageway 28.

Various optional features can be added to the golf club cover device 10. For example, as evident in FIGS. 1 and 3, a wing 49 extends from the main body 22 of the receiving member 20 just below the exit opening 30 of the passageway 28. The wing has a hole 50 extending laterally through it which serves to provide a means to receive a chain or cord for the towel 14. Holes 51 extending generally horizontally through the main body 22 of the receiving member 20 serve to receive the golf tees 15. Another hole 52 extending vertically into the connecting leg 35 of the receiving member 20 is used to hold the ball marker 16. Still other features can be added to hold pencils, scorecards and the like.

In use, the golfer assembles the golf club cover device by inserting the vertical leg of the L-shaped meshing member through the passageways found in the hooking leg and main body of the receiving member. The enlarged terminus found on its substantially horizontal leg prevents the L-shaped meshing member from passing fully through the main body passageway. Once assembled, the L-shaped meshing member is rocked back to a non-locking position and the vertical leg of the receiving member slipped over the open-top edge of the golf bag and forced downwardly as far as it will go. The golfer then pulls the vertical leg of the L-shaped meshing member to a more vertical position thereby at the same time causing the protuberance on the enlarged terminus to engage the golf bag. Once rocked back to its extreme, the golf club cover device is securely attached. It is just as easily removed by reversing the above steps.

The golf club cover device of the invention is economically produced. The receiving member and L-shaped meshing member are capable of being mass produced in molding operations. The two members are easily assembled by the manufacturer or the individual consumer. The device is readily installed on a golf bag. Only minimal instructions are needed. The device prominently displays any club cover placed on it due to the fact it is held an appreciable distance away from the golf bag and at least partially above the golf bag. Its simple but sturdy construction translates into durability.

While the invention has been described in detail and with particular reference to the drawings, it should be understood various modifications can be made. For example, the receiving member could be fabricated from two or more component pieces and secured together instead of being a one piece molded component as illustrated. All modifications and changes of an obvious nature are considered within the scope of the appended claims.

I claim:

1. A golf club cover device for semi-permanent attachment to a golf bag for holding a club head cover in a prominent manner, said golf club cover device comprising:

(a) a receiving member for hooking engagement with the golf bag, said receiving member having a main body and a hooking leg extending therefrom, wherein the main body has a front wall, a back wall, a substantially vertical first sidewall and a generally vertical second sidewall with a passageway extending therethrough such that an entry opening of the passageway is in the substantially vertical first sidewall adjacent said hooking leg and an exit opening of the passageway is in the generally vertical second side wall, further wherein the hooking leg extends substantially parallel to the substantially vertical first sidewall so as to create an open channel therebetween sufficiently wide to allow said receiving member to fit onto an open-top edge of the golf bag; and (b) an L-shaped meshing member positioned in the receiving member, said L-shaped meshing member having a substantially vertical leg and a substantially horizontal leg whereby the substantially vertical leg has a generally rounded knob to receive the club head cover and the substantially horizontal leg has an enlarged terminus with a protuberance dimensioned to be received within the passageway of the receiving member but not pass completely therethrough with the protuberance extending past the entry opening of said passageway such that the enlarged terminus is seated in the passageway in a manner which allows the L-shaped member meshing to be rocked from a non-locking position to a locking position by contact of the protuberance with the golf bag so as to hold the golf club cover device to the golf bag.

2. The golf club cover device of claim 1 wherein the passageway in the receiving member forms a cavity having a lower wall with a substantially flat horizontal surface extending from the entry opening to an approximate midpoint and then an inclined shoulder which extends to the exit opening and an upper wall with a generally arch-shaped surface.

3. The golf club cover device of claim 2 further wherein a connecting leg extends from a top area of the main body of the receiving member and the hooking leg extends from the connecting leg.

4. The golf club cover device of claim 3 further wherein a passageway extends through the hooking leg of the receiving member and is in alignment with the passageway extending through the main body of the receiving member.

5. The golf club cover device of claim 4 wherein the hooking leg has an inwardly projecting bump at its terminus to aid in holding the receiving member in position on the golf bag.

6. The golf club cover device of claim 1 wherein the protuberance of the L-shaped meshing member is positioned past center on the enlarged terminus so as to lock the golf club cover device onto the sidewall of the golf bag when the L-shaped meshing member is rocked into a locking position.

7. The golf club cover device of claim 6 wherein the enlarged terminus of the L-shaped meshing member is configured to rotate from about 30 degrees to about 60 degrees in the passageway of the main body of the receiving member.

8. The golf club cover device of claim 1 further wherein the vertical leg and rounded knob of the L-shaped meshing member is configured to receive an irons club cover.

9. The golf club cover device of claim 1 wherein the receiving member has holes extending generally horizontally through the main body to receive golf tees.

10. The golf club cover device of claim 3 wherein the receiving member has a hole extending vertically into the connecting leg to receive a ball marker.

11. The golf club cover device of claim 1 wherein the receiving member has a wing extending from its main body just below the exit opening of the passageway and further wherein a hole extends through the wing to receive a chain for a towel.

12. A golf club cover device for semi-permanent attachment to a golf bag for holding a club head cover for an iron in a prominent manner, said golf club cover device comprising:

(a) a receiving member for hooking engagement with the golf bag, said receiving member having a main body, a connecting leg extending from a top area of the main body, and a hooking leg extending downwardly from the connecting leg, wherein the main body has a front wall, a back wall, a substantially vertical first sidewall and a generally vertical second sidewall with a passageway extending therethrough such that an entry opening of the passageway is in the substantially vertical first sidewall adjacent said hooking leg and an exit opening of the passageway is in the generally vertical second side wall, further wherein the hooking leg extends substantially parallel to the substantially vertical first sidewall so as to create an open channel therebetween sufficiently wide to allow said receiving member to fit onto an open-top edge of the golf bag and has a passageway extending through it so as to be in alignment with the passageway in the main body; and (b) an L-shaped meshing member positioned in the receiving member, said L-shaped meshing member having a substantially vertical leg and a substantially horizontal leg whereby the substantially vertical leg has a generally rounded knob to receive the club head cover and the substantially horizontal leg has an enlarged terminus dimensioned to be received within the passageway of the receiving member but not pass completely therethrough and further the enlarged terminus has a protuberance positioned thereon past center so as to extend past the entry opening of said passageway, wherein the enlarged terminus is seated in the passageway in a manner which allows the L-shaped meshing member to be rocked from a non-locking position to a locking position by contact of the protuberance with the golf bag so as to hold the golf club cover device to the golf bag.

13. The golf club cover device of claim 12 wherein the passageway in the receiving member forms a cavity having a lower wall with a substantially flat horizontal surface extending from the entry opening to an approximate mid-point and then an inclined shoulder which extends to the exit opening and an upper wall with a generally arch-shaped surface.

14. The golf club cover device of claim 13 wherein the hooking leg has an inwardly projecting bump at its terminus to aid in holding the receiving member in position on the golf bag.

* * * * *